United States Patent [19]

Bagley et al.

[11] Patent Number: 4,566,544

[45] Date of Patent: Jan. 28, 1986

[54] FIRING SYSTEM FOR TUBING CONVEYED PERFORATING GUN

[75] Inventors: James T. Bagley, Sugar Land, Tex.; Maurice L. Simon, Breaux Bridge, La.

[73] Assignee: Schlumberger Technology Corporation, Houston, Tex.

[21] Appl. No.: 665,795

[22] Filed: Oct. 29, 1984

[51] Int. Cl.[4] ..... E21B 43/11

[52] U.S. Cl. ..... 175/4.56; 166/297; 166/55.1; 166/318

[58] Field of Search ..... 175/4.56, 4.59, 4.54, 175/4.53, 296, 297, 51, 293, 300; 166/297, 55, 313, 55.1, 318; 102/229

[56] References Cited

U.S. PATENT DOCUMENTS 3,189,094 6/1965 Hyde ..... 166/55.1 X
3,706,344 12/1972 Vann ..... 166/313 X
4,007,798 2/1977 Gazda ..... 175/297 X
4,158,334 6/1979 Osburn ..... 102/229 X
4,299,287 11/1981 Vann ..... 166/297 X

*Primary Examiner*—James A. Leppink
*Assistant Examiner*—David J. Bagnell

[57] ABSTRACT

A drop bar firing system is provided with a drop bar retracting means that insures that the lower end of the drop bar cannot come into contact with the firing head after a misfire, as the drop bar is fished or the tubing string removed. A safe arm mechanism requires the pressure in the well as the perforating gun is lowered into the well to arm the tubing conveyed perforating firing means. A safe position is automatically developed by the safe arm as the perforating gun is brought out of the well if a live gun must be retrieved. A specially shaped device to fire the tubing conveyed perforating detonator includes a probe of small diameter requiring a heavy impact on center.

8 Claims, 3 Drawing Figures

FIRING SYSTEM FOR TUBING CONVEYED PERFORATING GUN

BACKGROUND OF THE INVENTION

This invention relates in general to firing systems for tubing conveyed perforating guns and in particular to a drop bar firing system including safety means in the event of misfire.

Tubing conveyed perforating is a method of perforating oil well casing with perforating guns suspended from jointed tubing. Under certain completion designs and conditions, tubing conveyed perforating offers significant advantages over conventional wireline perforating.

Completion design plays an important role in the productivity of a well. Depending on reservoir characteristics, wells can be completed naturally, with sand-control measures or with some type of stimulation. The selection of perforating equipment and technique also are important to the productivity of a well. Tubing conveyed perforating provides improved perforator efficiency in all these types of completion. Long intervals can be perforated with large-diameter guns. Underbalanced perforating may be used with well flow initiated upon firing. Reservoir testing is possible with simultaneous perforating and measurement of pressure and flow.

The tubing conveyed perforating system consists of at least one perforating gun run into the well on the bottom of a string of production tubing or drillpipe. The perforating gun or guns may be assembled for any required length and shot density. A packer may be set to isolate the section of the well to be perforated from another section of the well. After gun positioning, firing is performed using one of several types of firing heads. If desired, after firing the gun or guns may be dropped into open casing below the new perforations, allowing access for production logging, use of slickline tools, or stimulation of perforations. Or the guns may be retrieved on the workstring after the well is under control.

One firing technique for tubing conveyed perforating is the drop bar firing system. In this system, a cylindrical weight or sinker bar is dropped or lowered into the tubing and strikes a percussion activated firing head attached to the top of a perforating gun. Vann, U.S. Pat. No. 3,706,344 includes a drop bar embodiment. As shown in FIGS. 1–7 of the Vann patent, a gun firing mechanism 22 is attached between tubing string 13 and casing gun 23. The gun firing mechanism includes a shaft 44 secured by brass shear pins 50 to an upstanding cylinder 42. To fire the system, a weight 45 is dropped or lowered into the tubing string and strikes the top of shaft 44, shearing pins 50 and bringing the lower end of shaft 44 into contact with tapered firing pin 51 within upstanding cylinder 42. Firing pin 51 is driven into rim fire cartridges 54 which activate primer cord detonator 39. The perforating gun shaped charges are activated by the primer cord. An intrinsic problem with the drop bar system is that the drop bar may not contact the firing head with sufficient force to activate the firing means because of debris clogged around the top of the firing head, drop bar sticking within the tubing or for other reasons. This misfiring creates a very dangerous situation as the drop bar must be fished or the tubing string removed from the well with armed charges attached and the drop bar stuck or resting above the armed firing head. Accidental firing at an incorrect depth is extremely damaging to the well and costly. Accidental at firing at the surface is extremely dangerous to well site personnel and equipment.

One object of the present invention is the elimination of this dangerous situation after misfire during drop bar fishing or tubing string removal.

SUMMARY OF THE INVENTION

One aspect of the present invention is a drop bar firing system with a drop bar retracting means that insures that the lower end of the drop bar cannot come into contact with the firing head after a misfire, as the drop bar is fished or the tubing string removed.

Another aspect of the present invention is a safe arm mechanism by which the pressure in the well as the perforating gun is lowered into the well is required to arm the tubing conveyed perforating firing means and by which a safe position is automatically developed as the perforating gun is brought out of the well if a live gun must be retrieved.

A further aspect of the present invention is the utilization of a specially shaped device to fire the tubing conveyed perforating detonator including a probe of small diameter requiring a heavy impact on center.

BRIEF DESCRIPTION OF THE DRAWINGS

Further objects and advantages of the present invention will be apparent from the following detailed description of the exemplary embodiments of the invention, taken in conjunction with the accompanying drawings, in which.

DESCRIPTION OF THE EXEMPLARY EMBODIMENTS

Figure 1:
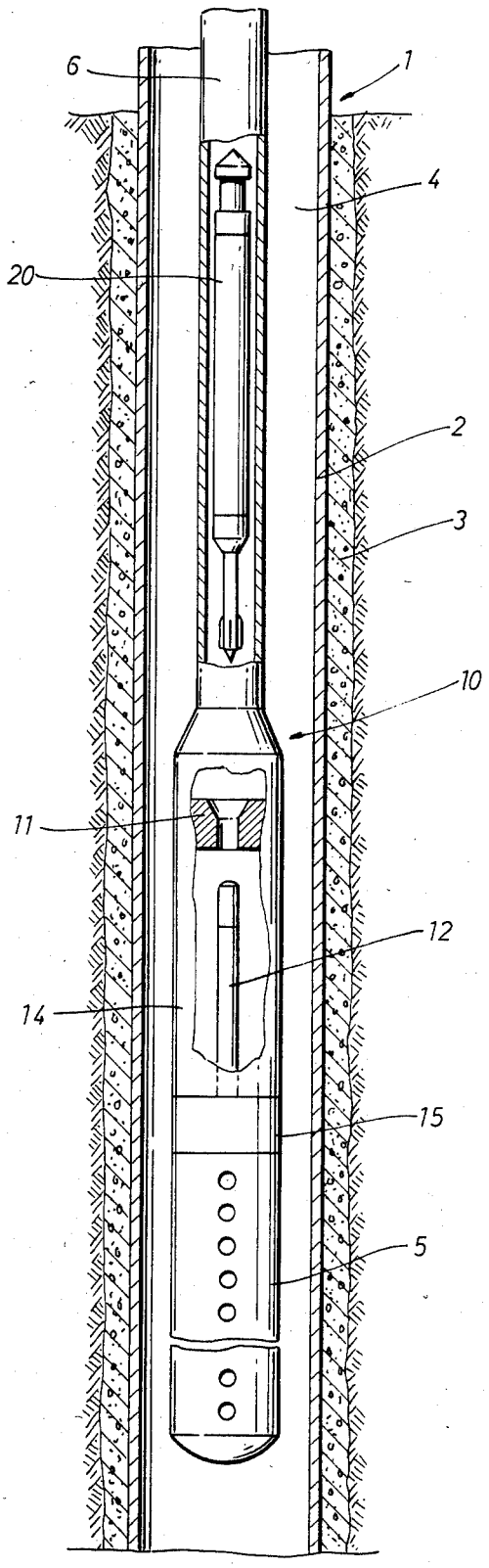
FIG. 1 is a representative of a tubing conveyed perforating lowered in a well with a drop bar firing system.

FIG. 1 depicts a typical cased borehole 1, having the usual steel casing 2, cement annulus 3 and well fluid 4. Tubing conveyed perforating gun carrier 5 is suspended within the cased borehole from tubing string 6. Drop bar 20 is shown unsupported in tubing string 6 above drop bar receiving section 10 immediately prior to contact and detonation. Drop bar receiving section 10 is connected between tubing string 6 and perforating gun carrier 5 and includes guide means 11, detonator housing assembly 12 within fill joint 14, and firing head adapter 15 attached to perforating gun carrier 5. The volume between detonator housing assembly 12 and fill joint 14 provides space for debris to settle out of the tubing without blocking the path to the detonator.

In one embodiment, detonator housing assembly 12 fixed within fill joint 14 and firing head adapter 15 may be considered the firing means of the firing system. As will be described in connection with FIG. 3, in a preferred embodiment, the inventive firing system may include a safe arm adapter 50 providing an interruption of detonating cord 70 of the firing means. Drop bar 20 and drop bar receiving section 10 will be described in detail below in connection with FIGS. 2 and 3, respectively.

Figure 2:
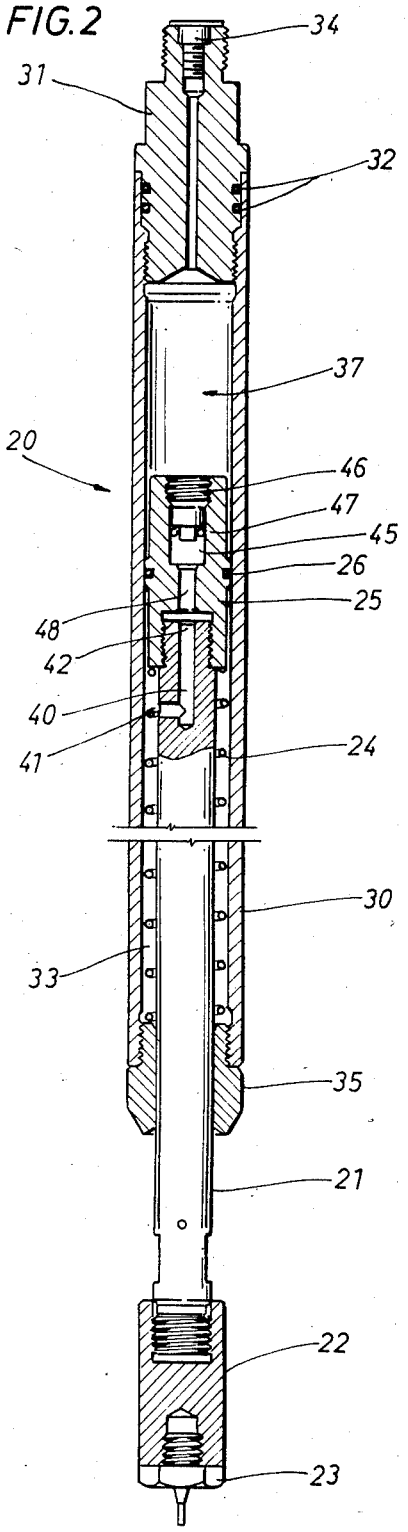
FIG. 2 depicts a drop bar assembly with a retracting mandrel.

FIG. 2 depicts a preferred embodiment of drop bar 20. The drop bar assembly includes spring mandrel 21 with nose guide 22 and firing pin 23 attached to the first end of spring mandrel 21. The second end of spring mandrel 21 is attached to piston 25 which is slidable within drop bar housing 30 and sealed by piston o-ring 26. In one embodiment, the spring mandrel may be secured to the piston by a set screw (not shown). A first end of drop bar housing 30 is closed off by upper adapter 31 including o-rings 32. Spring mandrel 21 and piston 25 are secured within housing 30 by mandrel guide 35 which is attached to the second end of drop bar housing 30. Spring 24 is compressible between piston 25 and mandrel guide 35 within housing 30. Oil chamber 37 comprises the space within housing 30 between upper adapter 31 and piston 25.

The second end of spring mandrel 21 includes a channel 40 which has a first port 41 below piston 25 for fluid communication with the housing interior 33. Alternatively, a full horizontal bore may be substituted for first port 41. The channel has a second port 42 aligned with a corresponding opening 48 in piston 25. Orifice means 45 is secured within piston 25 in fluid communication with oil chamber 37 and piston opening 48. Orifice means 45 is secured within piston 25 by orifice retainer 46 and o-ring 47. In operation, orifice means 45 serves to leak fluid from oil chamber 37 into housing interior 35 in order to slowly retract spring mandrel 21 within drop bar housing 30. Excess oil leaking into housing interior 33 may leak out of the drop bar and into the well between mandrel guide 35 and spring mandrel 21. Orifice means 45 comprises a stacked series of perforated and channeled plates providing tortuous flow paths between oil chamber 37 and piston opening 48. Other suitable flow restricting device may be substituted for the orifice means.

The particular oil used in the exemplary embodiment is a Dow-Corning type 200 silicon oil with viscosity of approximately 12,500 cs.

In one embodiment (not shown) a screen may be added between the orifice and the oil chamber to prevent orifice clogging, and the screen may be held in place by a cap attached to the piston. Also, for ease of assembly and installation, the orifice may be positioned adjacent the oil chamber rather than deeper within the piston as shown in the exemplary embodiment. In a preferred embodiment, upper adapter 31 may include a bleeder valve 34. Bleeder valve 34 is used during assembly to insure that oil chamber 37 is completely filled with oil and includes no air.

To assemble the drop bar, piston 25 is attached to spring mandrel 21 and tightened, and orifice means 45 is installed in piston 25. It should be noted that the piston and orifice are separate in this exemplary embodiment to facilitate manufacture; the combination could be a unitary structure. After the piston and spring mandrel are attached, spring 24 is slid over the spring mandrel and compressed. Mandrel guide 35 is pulled over the end of the spring mandrel and against the end of the spring. The spring is compressed against piston 25 until the mandrel guide passes over and exposes a hole (not shown) in the spring mandrel. A set pin is inserted in the hole to hold the spring and mandrel guide in position.

Next, nose guide 22 may be installed and the mandrel/spring assembly slid into housing 30, and the mandrel guide may be secured to the housing. Interspersed among the above assembly steps are lubricating steps to insure free piston movement within the housing.

To fill the drop bar with oil, upper adapter 31 is removed and the housing is maintained in a vertical position while the oil chamber is filled with oil above a full level. Bleeder valve 34 is loosened and the upper adapter is screwed into the housing, forcing oil out of bleeder valve 34 thus insuring that no air is left in the oil chamber.

The bar is ready for use, except for installation of the firing pin and pulling of the spring mandrel set pin. In this exemplary embodiment, the firing pin has a slim profile and it is recommended that the firing pin be left off until the bar is to be dropped in the well, to prevent damage to the firing pin.

The set pin is pulled just before the drop bar is released into the well and spring mandrel 21 begins slowly retracting. In the exemplary embodiment, the spring mandrel is fully retracted in one to five hours, depending on the temperature and pressure in the borehole. At a temperature of 200 degrees F. and 10,000 psi, the retraction time would be approximately 2 hours. This time period is adequate to allow attempts to unstick the drop bar by jarring or otherwise, or to prepare the rig for fishing attempts, should it be determined that firing was unsuccessful, before fishing for the drop bar or removing tubing.

As will be discussed below in the description of the operation of the firing system, in this embodiment of the invention, the outer surface of mandrel guide 35 serves as a stop means to fix the position of firing pin 23 in relation to the firing means, after retraction. Once the contacting end of the drop bar has retracted away from the firing means by the leaking of oil by orifice means 45 into housing interior 33, the contacting end of the drop bar will be fixedly separated from the firing means, insuring that no further firing will result from movement of the drop bar toward the firing means, if it is necessary to fish for the drop bar or to remove the tubing string and perforating gun carrier from the well.

Although it is unlikely, a misfiring may be caused by the nose guide becoming stuck in the guide means such that the firing pin does not reach the firing means. In such a case, debris may collect in the guide means above the stuck nose guide and interfere with retraction. In a further embodiment of the invention, longitudinal slots (see FIG. 1) may be added to the periphery of the nose guide to provide a path for the debris to travel through the guide means and settle within the fill joint. The usual misfiring results from the drop bar becoming stuck in the tubing string above the firing means, and the abutment provided by the beveled end of the guide means prevents the retracted contacting end of the drop bar from reaching the firing means, if the drop bar is unstuck and falls.

Figure 3:
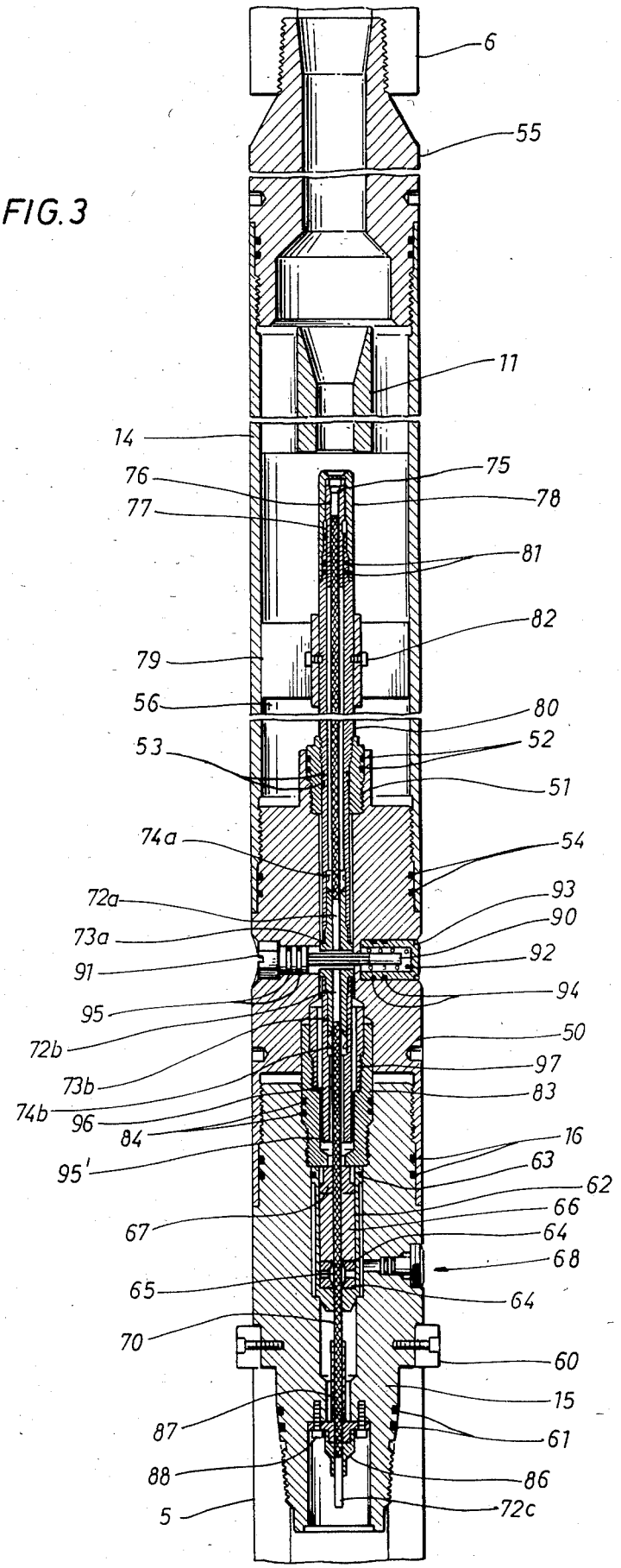
FIG. 3 depicts a drop bar receiving section of a firing means with a firing head attachment and a guide means.

FIG. 3 depicts drop bar receiving section 10 which is shown schematically in FIG. 1. Suspended from tubing string 6 is upper fill joint adapter 55 to which fill joint 14 is attached. Safe arm adapter 50 which supports detonator cord housing 80 is attached to the other end of fill joint 14 and the connection is sealed with o-rings 54. Firing head adapter 15 is attached to the other end of safe arm adapter 50 and the connection is sealed with o-rings 16. Transition collar 60 provides an outer diameter transition for the connection of firing head adapter 15 to perforating gun carrier 5. The connection may be sealed by o-rings 61. It should be noted that a spacer sub or other adapters may be attached between firing head adapter 15 and the perforating gun carrier as necessary to position and connect the perforating gun.

Guide means 11 is positioned within fill joint 14 above detonator 75 and serves to guide the contacting end of a descending drop bar into contact with the detonator. Guide means 11 includes a beveled upper end which serves as an abutment for the stop means of the drop bar which is discussed above.

Detonator 75 is held in place by detonator seat 76 on detonator seat support 77 within detonator cover 78. Detonator cover 78 is sealed to detonator cord housing 80 by o-rings 81. Detonator housing centralizer 79 is attached to detonator cord housing 80 by cap screws 82, centering detonator 75 within fill joint 14 and allowing a path for debris to travel through tubing string 6 and guide means 11 and settle around the detonator cord housing against safe arm adapter 50 and within fill joint interior 56. Detonator cord housing 80 is sealed to safe arm adapter 50 by adapter insert 51 and o-rings 52 and 53.

Within safe arm adapter 50, detonating cord 70 is interrupted by safe arm barrier 90. The ends of detonating cord 70 on both sides of safe arm barrier 90 are connected to detonating boosters **72*a* and 72*b*. Upper booster 72*a* is secured within detonating cord housing 80 by booster retainer 73*a* and detonating cord collet 74*a* centers the detonating cord within the detonating cord housing. Lower booster 72*b* is secured within detonating cord carrier 95' by booster retainer 73*b* and and the detonating cord is centered within the carrier by detonating cord collet 74*b***.

The safe arm system includes safe arm barrier 90 which has an open segment (open cross section not shown) which is moved into alignment with the firing path between booster **72*a* and booster 72*b* in the armed position. As depicted in FIG. 3, the barrier is in the safe position and explosive force is prevented from crossing the barrier. Slotted barrier retainer 91 abuts one end of safe arm barrier 90 and holds it in place against spring 92 and spring retainer 93 which is sealed within the safe arm adapter body by o-rings 94. O-rings 95 seal the chamber in which the barrier rests from the well bore fluids admitted through slotted barrier retainer 91**. As the firing means is lowered into the well, pressure acting on the safe arm barrier brings the open segment into alignment with the booster firing path, arming the firing means.

As is evident from FIG. 3, safe arm adapter 50 is optional, and fill joint 14 may be connected directly to firing head adapter 15 without interruption in the detonating cord. As long as detonator 70 can transmit explosive force to lower booster **72*c***, the firing means will be armed. In another embodiment, safe arm adapter may be mandatory.

Firing head adapter 15 has a longitudinal bore through which detonating cord 70 is threaded. At one end of firing head adapter 15, detonating cord 70 is attached to force receiving booster **72*b* and in the other end detonating cord 70 is attached to force transmitting booster 72*c*. Seal housing 62 surrounding detonating cord 70 is sealed within the longitudinal bore of the firing head adapter by o-ring 63. The seal housing supports compression plate 64, compression bushing 65, energizing seal 66 and seal gland 67 around detonating cord 70. The outside surface of seal housing 62 below o-ring 63 is in fluid communication with pressure vent assembly 68, which includes a pressure vent lock nut and a pressure stud with an o-ring seal (not shown). Seal housing 62 along with seal gland 67, energizing seal 66, compression plate 64 and compression bushing 65 are necessitated by the fact that the puncturing of detonator cover 78 opens the system to well fluids. This seal housing and seal assembly operates to keep fluids away from the perforating gun carrier in the event of a misfire. In another embodiment (not shown), the seal assembly may be replaced by a steel piston supported within the seal housing by a collet and sealed within the seal housing by o-rings and against the detonating cord by a elastomeric tube. Pressure vent assembly 68 is intended to permit easy venting of the explosion gases generated by the detonator, the detonating cord, the boosters and the gun charges after the firing system is removed from the well, so that the adapters, fill joint and charge carrier assembly may be dismantled without danger of pressure release. The longitudinal bore within firing head adapter 15 includes firing head adapter insert 83 sealed within its upper end by o-rings 84 for supporting detonating cord carrier 95' on snap ring 96 which is clamped by shield 97**.

Lower booster **72*c* is crimped to the lower end of detonating cord 70 and the cord and booster are held within the logitudinal bore of firing head adapter 15 by collet chuck 86 within transfer module 87. Transfer module 87 is secured to firing head adapter 15 by cap screws 88. Accordingly, force transmitting lower booster 72*c* is prepared for connection to a force receiving booster (not shown) in the upper end of the perforating gun assembly for transmitting the explosive force first generated by detonator 75** to the perforating gun charges.

Collet chuck 86 and collets **74*a* and 74*b* grip detonating cord 70 beyond boosters 72*c*, 72*a* and 72*b***, respectively and hold the boosters in place, insuring proper alignment.

It should be noted that although several adapter structures are described in connection with the exemplary embodiment of the invention, they are utilized because of specific tubing and perforating gun carrier sizes which may vary in different applications of the present inventive system. Choice of adapter elements to obtain correct connection of the firing system would be a simple expedient to one skilled in the art of perforating.

The firing system may be assembled in large part before transportation to the well site and armed at the well site. The detonator cord, boosters, sealing elements and other components in both the firing head adapter and the safe arm adapter may be assembled during shop preparation, without installation of the detonator, allowing a degree of safety during transportation to the wellsite. When the firing means is ready to be lowered into the well, the detonator, detonator seat and detonator cover may be installed and the fill joint and guide means assembled with the firing head adapter and safe arm adapter. The assembled firing means is ready for connection to the perforating gun carrier and lowering into the well at the end of the tubing string.

The tubing conveyed perforating gun is fired by the inventive firing system as follows. The drop bar is activated by removal of the pin in spring mandrel 21 so that piston 25 is compressed by spring 24 against the filled oil chamber 37. Upon activation, firing pin begins its gradual retraction toward mandrel guide or stop means 35. Drop bar 20 is next lowered or released into tubing string 6 and nose guide 22 travels through guide means 11 bringing firing pin 23 into contact with detonator 75 and setting in motion the firing of the perforating gun. At the time of detonation, the nose piece has retracted to a certain degree while falling but not sufficiently to prevent firing. In the event of a misfire, the retraction continues and by the time that fishing or tubing removal are attempted, the distance between the firing pin and the mandrel guide is less than the corresponding distance between the beveled end or stop means of the guide means. Accordingly, should the drop bar move toward contacting the firing means during fishing or tubing removal, detonation of the firing means if not possible.

It is to be understood that the invention is not limited to the exact details of construction, operation, exact materials, or embodiment shown and described, as modifications and equivalents will be apparent to one skilled in the art without departing from the scope of the invention. For example, in another embodiment of the invention, the retracting means of the exemplary embodiment may be replaced by another means which is activated by pressure change after the drop bar is introduced into the well such as when pressure is reduced as the drop bar is raised from the well after a misfire. Accordingly, the invention is to be limited only by the scope of the appended claims.

We claim:

1. A system for firing a tubing conveyed perforating gun suspended in a well utilizing a drop bar and comprising:

(a) a percussion activated firing means attached between a tubing string and at least one perforating gun, said firing means including a first end adjacent the tubing string for receiving an activating force and a second end adjacent said at least one perforating gun for transmitting an explosive force to said at least one perforating gun;

(b) a drop bar for introducing into the tubing and contacting the first end of said firing means, said drop bar including a housing with an attached stop means, a mandrel movably attached to the housing, and a contacting end attached to the mandrel and movable in relation to the stop means, said drop bar further comprising a retracting means for moving the contacting end toward the stop means after the retracting means is activated;

(c) guide means for receiving said drop bar and directing said contacting end toward the first end of said firing means; and, (d) abutment means fixed in relation to said firing means for receiving said stop means, whereby after said retracting means is activated said retracting means moves the contacting end of said drop bar toward said stop means to such an extent that contact of the stop means and the abutment means prevents the contacting end of the drop bar from reaching and detonating the firing means, so that the drop bar may be safely fished from the tubing or the guns safely removed from the well in the event of a misfire.

2. The firing system of claim 1 wherein the retracting means is activated prior to insertion of the drop bar into the tubing string.

3. The firing system of claim 2 wherein the retracting means comprises a spring loaded piston attached to said mandrel which leaks oil from an oil chamber, retracting the piston and mandrel into the oil chamber as the oil leaks.

4. The firing system of claim 1 wherein the retracting means is activated by a drop in pressure.

5. The firing system of claim 1 wherein the abutment means comprises a beveled upper end portion of the guide means.

6. The firing system of claim 1 further comprising well pressure activated safe arm means interrupting a detonating cord between said first and second ends of said firing means.

7. The firing system of claim 6 wherein the safe arm means comprises a safe arm barrier with an open segment which may be moved into alignment with boosters attached to the ends of the interrupted detonating cord by the pressure of the well fluid as the firing means is lowered into the well, and out of alignment into a safety position as the firing means is raised from the well.

8. The firing system of claim 1 wherein said contacting end comprises a firing pin of relatively small diameter providing heavy impact upon the center of the first end of said firing means during firing.

* * * * *